United States Patent [19]

Pernick

[11] Patent Number: 4,682,479

[45] Date of Patent: Jul. 28, 1987

[54] SEAMLESS KNIT COMPOSITE GARMENT BLANK AND METHOD

[76] Inventor: Bruce M. Pernick, 74-10 88th St., Glendale, N.Y. 11385

[21] Appl. No.: 907,808

[22] Filed: Sep. 16, 1986

[51] Int. Cl.[4] ..... A41B 9/00

[52] U.S. Cl. ..... 66/176; 66/189

[58] Field of Search ..... 66/174, 175, 176, 177, 66/189

[56] References Cited

U.S. PATENT DOCUMENTS

| | | | |
|---|---|---|---|
| 1,831,192 | 11/1931 | Persky | 66/176 |
| 2,285,012 | 6/1942 | Burkey | 66/177 |
| 3,985,003 | 10/1976 | Reed | 66/177 X |
| 4,010,627 | 3/1977 | Pernick | 66/177 |

*Primary Examiner*—Wm. Carter Reynolds

*Attorney, Agent, or Firm*—Bell, Seltzer, Park & Gibson

[57] ABSTRACT

A composite garment blank is knit to provide first and second individual panty garment blanks having portions in intermating relationship. The panty portions of the individual panty blanks are positioned on opposite end portions of the composite garment blank and include corresponding fashioned front and rear sections which extend inwardly of the composite panty garment blank and are offset in 90 degree relationship to each other so that the inwardly extending fashioned front and rear sections of one individual panty blank intermate or nest with and are spaced apart by unknit areas between the fashioned front and rear sections of the other panty garment blank. This intermating arrangement of the inwardly extending portions of the individual panty blanks permits the simultaneous knitting of the inwardly extending portions of one panty blank with and while not knitting between the inwardly extending portions of the other panty blank.

6 Claims, 6 Drawing Figures

SEAMLESS KNIT COMPOSITE GARMENT BLANK AND METHOD

FIELD OF THE INVENTION

This invention relates generally to a seamless knit composite garment blank including first and second individual garment blanks with adjacent end portions in interconnected and intermating relationship, and more particularly to a composite garment blank wherein each of the individual blanks includes a panty portion formed of successive complete courses and positioned at opposite end portions of the seamless knit composite garment blank. Successive partial courses form fashioned front and rear panels and front and rear crotch panels extending inwardly from the corresponding panty portions and in offset relationship to each other so that the front and rear panels and front and rear crotch panels of one garment blank are positioned between and in interconnected and intermating relationship with the corresponding panels of the other garment blank. This arrangement permits the simultaneous knitting of the inwardly extending portions of one garment blank on spaced-apart sets or groups of adjacent needles in the needle cylinder while the inwardly extending portions of the other garment blank are being knit on other sets or groups of adjacent needles, and while not knitting between the inwardly extending portions of both garment blanks, during continuous rotary motion of the needle cylinder.

BACKGROUND OF THE INVENTION

U.S. Pat. No. 4,010,627 discloses a panty garment and blank and U.S. Pat. No. 4,043,156 discloses the method of knitting the panty blank of the aforesaid patent. The panty garment of these two patents is knit entirely by rotary knitting on a circular knitting machine by first knitting a plurality of successive complete courses to form a seamless lower trunk portion, knitting spaced seamless nontubular front and rear narrowed panels on spaced-apart sets or groups of adjacent needles on opposite sides of the needle cylinder to form fashioned front and rear panels, and then knitting corresponding front and rear crotch panels as continuations of the corresponding front and rear panels by knitting successive partial courses of the same length on groups of adjacent needles on opposite sides of the needle cylinder. The panty is then formed by joining together the end portions of the crotch panels to form leg openings on opposite sides thereof. A suitable elastic trimming may then be attached around the leg openings.

The knitting of individual panty garment blanks, in accordance with these prior patents, requires the knitting of pairs of spaced-apart partial courses with less than half of the needles being in an active knitting position during each rotation of the needle cylinder while the remaining needles are in an inactive or idle position and are not producing fabric. Thus, the same length of time is required for knitting the complete successive courses in the lower trunk portion as the time required for knitting only narrow nontubular partial courses in the fashioned front and rear and crotch panels, and many of the needles in the needle cylinder are in an idle condition during the rotary knitting of the partial courses of the fashioned front and rear panels and the crotch panels. The knitting of individual panty garment blanks in the manner disclosed in these prior patents is relatively slow, thereby increasing the production costs.

SUMMARY OF THE INVENTION

With the foregoing in mind, it is an object of the present invention to provide an elongate seamless knit composite garment blank including first and second individual garment blanks with adjacent fashioned portions in interconnected and intermating relationship so that the intermating portions of the individual blanks can be simultaneously knit during continuous rotation of the needle, thereby reducing the time required to knit individual garment blanks in the manner disclosed in said prior patents.

The inwardly extending fashioned portions of the composite garment blank of the present invention are in nested relationship so that the fashioned front and rear panels and crotch panels of one blank are in ninety degree offset relationship with the inwardly extending fashioned front and rear panels and crotch panels of the other blank, and with unknit areas between the panels of both blanks. This offset and intermating relationship of the inner end portions of the first and second individual blanks permits the simultaneous knitting of partial courses on spaced-apart sets or groups of adjacent needles on opposed sides of the needle cylinder. The simultaneous knitting of the partial courses of both garment blanks during each rotation of the needle cylinder while knitting the medial portion of the seamless knit composite garment blank greatly reduces the length of time required to knit successive individual garment blanks, as disclosed in the aforesaid prior patents.

The seamless knit composite garment blank of the present invention permits the desired shape to be imparted to the front and rear panels of each of the first and second individual blanks and also permits the length and shape of the fashioned panels to be varied as desired. During the continuous rotary knitting operation, the yarn may float in the unknit areas from the trailing edge of the partial course formed in one garment blank to the leading edge of the partial course in the other garment blank so that the first and second blanks are interconnected by the floats when the knitting of the seamless knit composite garment blank is completed. Then, the floats may be cut to separate the first and second individual garment blanks from each other. Also, the yarn floats which would normally extend across the unknit areas and between adjacent partial courses of the first and second individual blanks may be cut while the blank is being knit on the knitting machine so that the individual blanks are not interconnected between adjacent partial courses. The terminal ends of the crotch panels of one blank may be interknit with the tubular portions of the other blank while the composite blank is being knit.

The seamless knit composite garment blank is preferably knit of stretchable yarn so that the individual garments will fit a range of various body sizes. The composite garment blank may be knit on circular knitting machines of various needle cylinder diameters so that the diameter of the garment can be varied to fit small, large and queen size wearers. While the composite garment blank of the present invention is adapted to provide two individual blanks for forming panty garments, it is to be understood that the composite garment blank could be extended on opposite ends to form other types of body garments, such as leotards, bathing suits, girdles, and the like.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
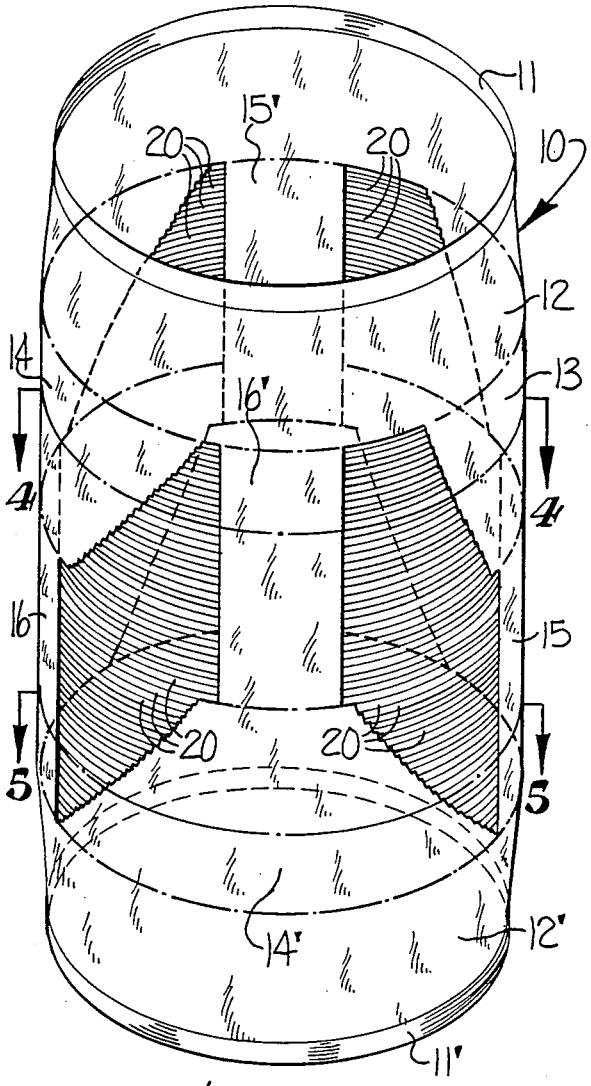
FIG. 1 is a perspective view of the elongate seamless knit composite garment blank of the present invention illustrating the manner in which it is knit on a circular knitting machine with the inner portions of the first and second individual blanks in intermating relationship.

As illustrated in FIG. 1, the elongate seamless knit composite panty garment blank of the present invention includes respective first and second individual panty garment blanks, broadly indicated at 10, 10', shown in interconnected and intermating relationship. Each of the individual panty garments 10, 10' includes respective turned welt type waistbands 11, 11' and a plurality of successive complete courses forming seamless lower trunk engaging panty portions 12, 12'. As illustrated in FIG. 1, the panty portions 12, 12' and the waistbands 11, 11' of the first and second individual panty garment blanks are positioned on opposite end portions and extend completely around the elongate composite panty garment blank.

A plurality of successive partial courses form spaced-apart and fashioned front and rear fashioned sections including respective fashioned front and rear panels 13, 13' and 14, 14'. The fashioned front and rear panels 13, 13' and 14, 14' of the first and second individual panty blanks 10, 10' are integrally knit with and extend inwardly from the corresponding panty portions 12, 12'. The fashioned front and rear fashioned sections also include a plurality of successive partial courses of the same length which form respective front and rear crotch panels 15, 15' and 16, 16'. The crotch panels 15, 15' and 16, 16' are integrally knit with and extend inwardly from the corresponding fashioned front and rear panels 13, 13' and 14, 14' of the fashioned front and first and second individual panty garment blanks 10, 10'.

The central portions of the fashioned front and rear panels 13, 14 and the crotch panels 15, 16 of the first individual panty garment blank 10 are offset 90 degrees around the elongate seamless knit composite panty garment blank relative to the central portions of the fashioned front and rear panels 13', 14' and the corresponding crotch panels 15', 16' of the second individual panty garment blank 10'. The inwardly extending fashioned front and rear panels 13, 14 and corresponding crotch panels 15, 16 of the first individual panty garment blank 10 are positioned between the inwardly extending fashioned front and rear panels 13', 14' and corresponding crotch panels 15', 16' of the second individual panty garment blank 10'.

Figure 3:
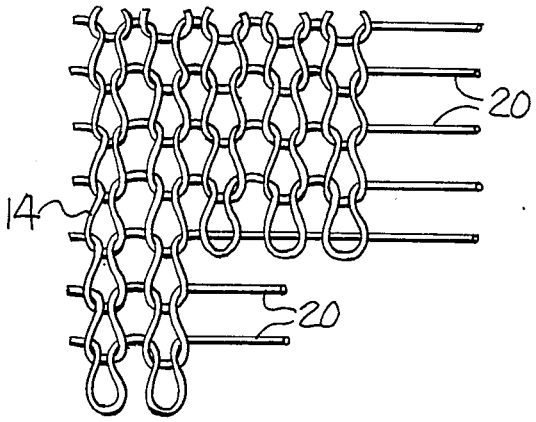
FIG. 3 is a greatly enlarged fragmentary view of the edge portion of the fabric, being taken substantially in the rectangle 3 in FIG. 2 and illustrating the manner in which the partial courses are reduced in length or narrowed.
Figure 4:
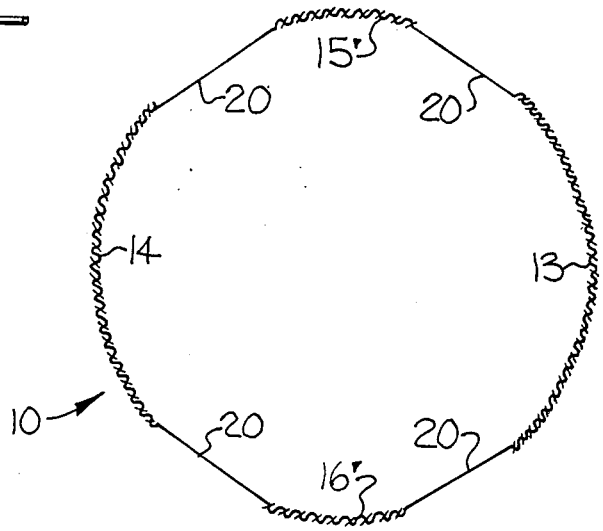
FIG. 4 is a schematic horizontal sectional view taken substantially along the line 4—4 in FIG. 1 and illustrating the manner in which spaced partial courses in both blanks are simultaneously knit.
Figure 5:
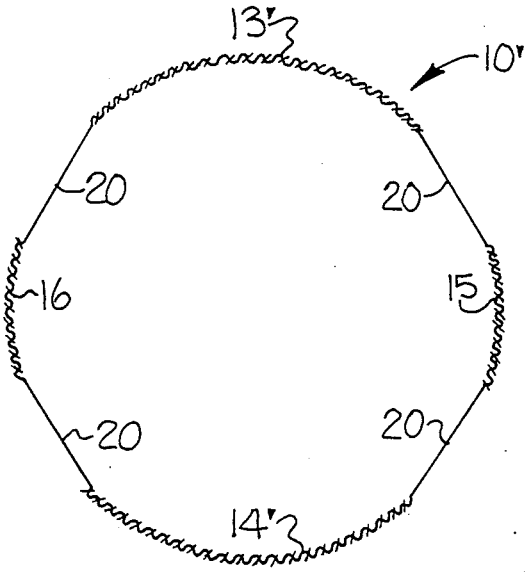
FIG. 5 is a view similar to FIG. 4 but being taken substantially along the line 5—5 in FIG. 1.

As illustrated in FIGS. 1, 4 and 5, unknit floats 20 extend between and connect the adjacent edges of the front and rear panels 13, 14 and the crotch panels 15', 16' in the upper portion of the composite panty garment blank. Also, floats 20 extend between and connect adjacent endmost stitch loops of the partial courses forming the front and rear panels 13', 14' and the crotch panels 15, 16 in the lower portion of the composite panty garment blank. Thus, the opposite ends of the simultaneously knit partial courses of the panels of the second garment blank are spaced from the opposite ends of the knit partial courses of the panels of the first garment blank. A fragmentary portion of the narrowed edge of the rear panel 14 is illustrated in FIG. 3 and indicates that the fashioning of the front and rear panels is carried out by knitting a plurality of partial courses of the same length and then reducing the number of needles knitting for the next plurality of partial courses to provide a stepped edge along the fashioned panels. It is to be understood that the number of partial courses knit of the same length, and the number of needles removed from knitting action can be varied so that the dimensions and shape of the opposite edges of the front and rear fashioned panels can be varied, as desired.

Method of Knittinq

The composite panty garment blank, as illustrated in FIG. 1, is knit entirely by rotary knitting upon a circular knitting machine provided with a circle of needles of suitable diameter, yarn clamp and cutter means, and needle selecting means of a conventional type. While a single feed knitting machine may be used, it is preferred that a multiple feed knitting machine be employed to reduce the time required to knit the blank. The knitting of the composite panty garment blank of FIG. 1 will be described as if it is being knit from the top to the bottom and it is to be understood that the blank may be knit in the reverse manner, if desired. The waistband 11 is preferably of the turned welt type and may include elastic yarn incorporated therein to provide elasticity to the waistband of the garment. The waistband 11 may be formed on conventional transfer hooks and the needles in a conventional manner to form an inwardly turned welt of the desired width, or it may be formed on the cylinder needles to provide a conventional type outwardly turned welt. Also, the waistband 11 may be of a single thickness or ply of knit fabric and the finished panty may be provided with a woven elastic tape attached thereto to provide the waistband, if desired.

With continued rotary motion of the needle cylinder, and with all needles knitting, successive complete courses are formed to provide the desired length of fabric in the panty portion 12. When the lower terminal complete course of the panty portion 12 is completed, the needles are selected and rotary knitting continues on spaced-apart groups or sets of adjacent needles while the needles therebetween are positioned in an idle or nonknitting position. With each continued rotation of the needle cylinder, one or more partial courses is knit simultaneously on the spaced-apart groups of needles to form the fashioned front and rear panels 13, 14 of the first panty blank 10 and the crotch panels 15', 16' of the second panty blank 10' while not knitting between the panels of both blanks so that the yarn floats 20 extend between the spaced-apart adjacent edges of the knit portions. As rotary knitting continues, the number of needles knitting to form the front and rear panels 13, 14 is gradually reduced so that these fabric areas are narrowed while the number of needles knitting the crotch panels 15', 16' remains the same to form partial courses of the same length therein. Thus, with each rotation of the needle cylinder, spaced-apart portions of the first individual panty garment blank 10 are formed while portions of the second individual panty garment blank 10' are also formed between the portions being formed of the first individual panty garment blank 10. Upon completion of the knitting of the final fashioned partial course of the front and rear panels 13, 14, rotary knitting continues while simultaneously knitting the partial courses in the crotch panels 15, 16 and 15', 16' until knitting of the widened front and rear panels 13', 14' begins.

Figure 2:
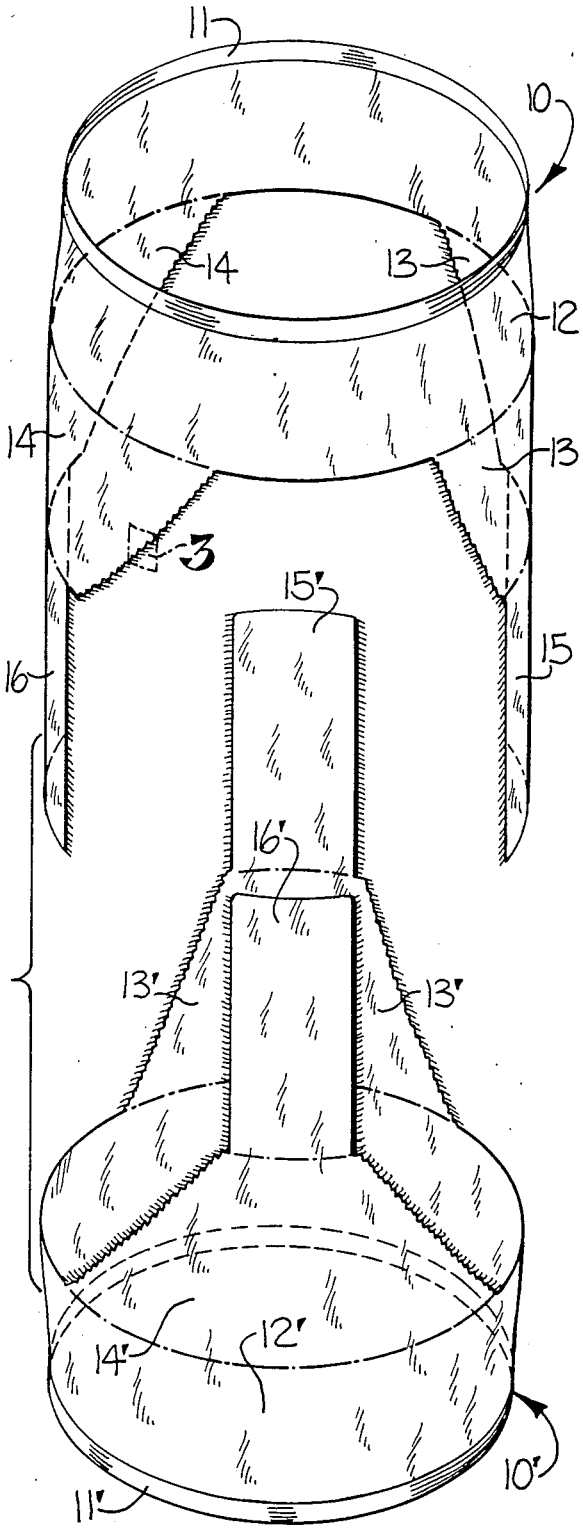
FIG. 2 is a view similar to FIG. 1 but showing the float yarns connecting the first and second individual blanks being clipped and the individual blanks being separated from each other.

As rotary knitting continues, the number of needles forming the partial courses in the front and rear fashioned panels 13', 14' is gradually increased while the number of needles knitting in the spaced groups therebetween and forming the crotch panels 15, 16 remains the same and the floats 20 connect the adjacent knit portions. After the required length of fabric has been knit to form the front and rear fashioned panels 13', 14', all of the needles are selected and moved to an active or knitting position and a full course is knit at the upper end of the panty portion 12' of the second individual panty garment blank 10'. A sufficient number of complete circular courses are then formed to complete the required length of the body portion 12'. The turned welt 11' is then formed in a conventional manner to complete the knitting of the composite panty garment blank. Upon completion of the knitting of the composite panty garment blank, it is released from the knitting machine and the individual panty garment blanks 10, 10' are separated by cutting the floats 20 and separating the ends of the crotch panels from the adjacent panty portions, as illustrated in FIG. 2.

Figure 6:
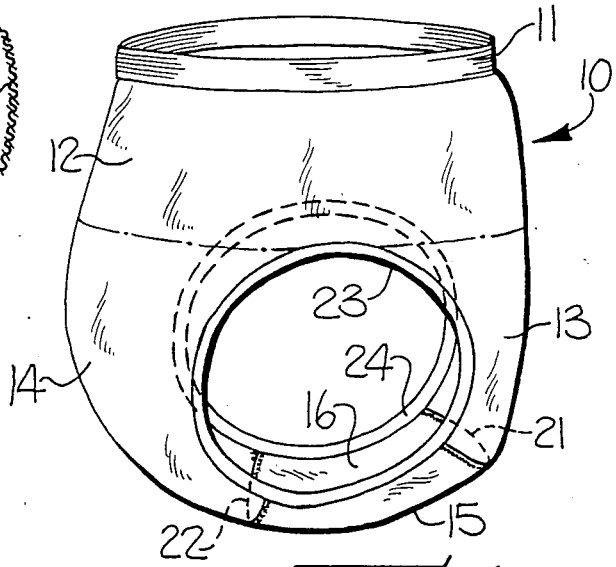
FIG. 6 is a perspective view looking at one side portion of a finished panty formed from one of the individual panty blanks of FIG. 2.

The finished panty, as illustrated in FIG. 6, is formed from one of the individual blanks by simply connecting together the lower ends of the crotch panels 15, 16. The crotch panels 15, 16 are preferably connected together in overlapping relationship by means of transversely extending juncture seams 21, 22, to form leg openings. Suitable elastic trimming, such as is illustrated at 23, 24, is then sewn in position around each of the two leg openings to complete the panty.

While the seamless knit composite panty garment blank of the present invention has been described as being knit in a suitable form to form a pair of individual panties therefrom, it is to be understood that the seamless knit composite garment blank may also include further portions on opposite ends thereof to form a pair of bathing suit blanks, leotards, or the like, and wherein the additional knit portions may form upper breast covering portions of such garments. Also, the fashioned front and rear panels of the individual panty blanks may be extended to eliminate the crotch panels and the ends of the front and rear panels can be connected together in the crotch area of the panty.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An elongate seamless knit composite garment blank including first and second individual garment blanks having portions in intermating relationship, each of said individual garment blanks comprising (a) a panty portion including a plurality of successive complete courses forming a seamless lower trunk portion, said panty portions of said first and second individual garment blanks being positioned on opposite end portions and extending completely around said elongate seamless knit composite garment blank, (b) a plurality of successive partial courses forming fashioned front and rear sections integrally knit with and extending inwardly from corresponding panty portions of said first and second individual garment blanks, said fashioned front and rear sections of said first and second individual garment blanks including front and rear fashioned panels and front and rear crotch panels having terminal ends, said crotch panels of said first and second individual garment blanks being integrally knit with and extending inwardly from corresponding fashioned front and rear panels of said first and second individual garment blanks, (c) central portions of said fashioned front and rear sections of said first individual garment blank being offset 90 degrees around said elongate seamless knit composite garment blank relative to the central portions of said fashioned front and rear sections of said second individual garment blank, and (d) said inwardly extending fashioned front and rear sections of said first individual garment blank being positioned between and in intermating relationship with said inwardly extending fashioned front and rear sections of said second individual garment blank, and with the innermost ends of said crotch panels of said first and second individual garment blanks being interknit with corresponding portions of said panty portions of said first and second individual garment blanks.

2. An elongate seamless knit composite garment blank according to claim 1 including unknit yarns connecting adjacent edges of said fashioned front and rear sections of said first individual garment blank to the corresponding adjacent edges of said fashioned front and rear sections of said second individual garment blank.

3. An elongate seamless knit composite garment blank according to claim 1 wherein said first and second individual garment blanks are adapted to form panties, and wherein a turned welt is formed at each end of said elongate seamless knit garment blank to provide an integrally knit waistband for each of said individual panty blanks.

4. An elongate seamless knit composite garment blank according to claim 2 wherein opposite edges of said front and rear crotch panels of both said first and second garment blanks are substantially straight and extend walewise of said garment blank, and wherein opposite edges of said fashioned front and rear panels of both said first and second garment blanks extend at an angle relative to the wales of said garment blank.

5. A method of knitting an elongate seamless knit composite garment blank including first and second individual garment blanks having portions in intermating relationship, said method including the steps of (a) knitting a plurality of successive complete courses and forming a panty portion of said first individual garment blank, (b) knitting a plurality of successive partial courses in spaced-apart relationship and on opposite sides of said panty portion and forming fashioned front and rear sections of said first garment blank, (c) and while simultaneously knitting successive partial courses in spaced-apart relationship and between the partial courses forming said front and rear panels of said first garment blank and forming fashioned front and rear sections of said second garment blank, and while not knitting between said front and rear panels of both blanks whereby opposite ends of said simultaneously knit partial courses of said front and rear panels of said second garment blank are spaced from opposite ends of said simultaneously knit partial courses of said front and rear panels of said first garment blank, and (d) knitting a plurality of successive complete courses interknit with said front and rear fashioned sections of said second individual garment blank and forming a panty portion of said second individual garment blank.

6. A method according to claim 5 including the step of floating the yarn between the adjacent partial courses during the knitting of the fashioned front and rear sections of said first and second individual garment blanks.

* * * * *